US010837223B2

(12) United States Patent
Miller

(10) Patent No.: US 10,837,223 B2
(45) **Date of Patent: *Nov. 17, 2020**

(54) SYSTEM AND METHOD FOR A SECURITY FILM

(71) Applicant: Tim Miller, Lewisville, TX (US)

(72) Inventor: Tim Miller, Lewisville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/520,956

(22) Filed: Jul. 24, 2019

(65) Prior Publication Data

US 2019/0345753 A1 Nov. 14, 2019

Related U.S. Application Data

(63) Continuation of application No. 15/911,431, filed on Mar. 5, 2018, now Pat. No. 10,400,503, which is a continuation of application No. 15/343,285, filed on Nov. 4, 2016, now Pat. No. 9,938,763.

(60) Provisional application No. 62/251,260, filed on Nov. 5, 2015.

(51) Int. Cl.

| | |
|---|---|
| ***E04C 2/00*** | (2006.01) |
| ***E06B 3/54*** | (2006.01) |
| ***E06B 5/10*** | (2006.01) |
| ***E06B 3/58*** | (2006.01) |
| ***E06B 5/11*** | (2006.01) |

(52) U.S. Cl.

CPC ..... *E06B 3/549* (2013.01); *E06B 3/5892* (2013.01); *E06B 5/10* (2013.01); *E06B 5/103* (2013.01); *E06B 5/116* (2013.01)

(58) Field of Classification Search

CPC . E06B 3/7001; E06B 3/70; E06B 5/10; E06B 5/11; E06B 3/30; E06B 3/26307; E06B 2009/005; E06B 9/00; E06B 3/26309; E06B 3/263; E06B 9/01; E06B 5/00; E06B 5/003; E06B 5/116; E06B 5/12

USPC ..... 52/782.1, 203, 204.5, 204.53, 717.01, 52/455, 456, 457, 458, 204.62, 204.561, 52/208, 785.1, 784.1, 786.1

See application file for complete search history.

(56) References Cited

U.S. PATENT DOCUMENTS

| | | | | |
|---|---|---|---|---|
| 9,938,763 | B2 * | 4/2018 | Miller | E06B 3/549 |
| 10,400,503 | B2 * | 8/2019 | Miller | E06B 3/549 |

* cited by examiner

*Primary Examiner* — Chi Q Nguyen

(74) *Attorney, Agent, or Firm* — Braxton Perrone, PLLC; Bobby W. Braxton; Gregory Perrone

(57) ABSTRACT

A system and method for a security glass system. The system includes a pane of glass and a security film adhered to the glass. A bracket has a glass coupler portion, a gap definer, and a support coupler. The glass coupler is adhered to the security film via an adhesive. The support coupler is adhered to the support via an adhesive. The result is a securement system which can withstand more blows than traditional glass.

11 Claims, 4 Drawing Sheets

SYSTEM AND METHOD FOR A SECURITY FILM

PRIORITY

This application is a continuation of application Ser. No. 15/911,431, filed Mar. 5, 2018 which is a continuation of application Ser. No. 15/343,285, filed Nov. 4, 2016, now U.S. Pat. No. 9,938,763, which claims priority to U.S. Provisional Application No. 62/251,260 filed Nov. 5, 2015, the entirety of all are hereby incorporated by reference.

BACKGROUND OF THE INVENTION

Technical Field

The present invention relates to a system and method for installing and securing glass having a security film.

Description of Related Art

Glass is typically the weak point many criminals exploit in order to gain entry into a building or home. Consequently, it is desirable to have a system and method which allows for increased security compared to the prior art.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
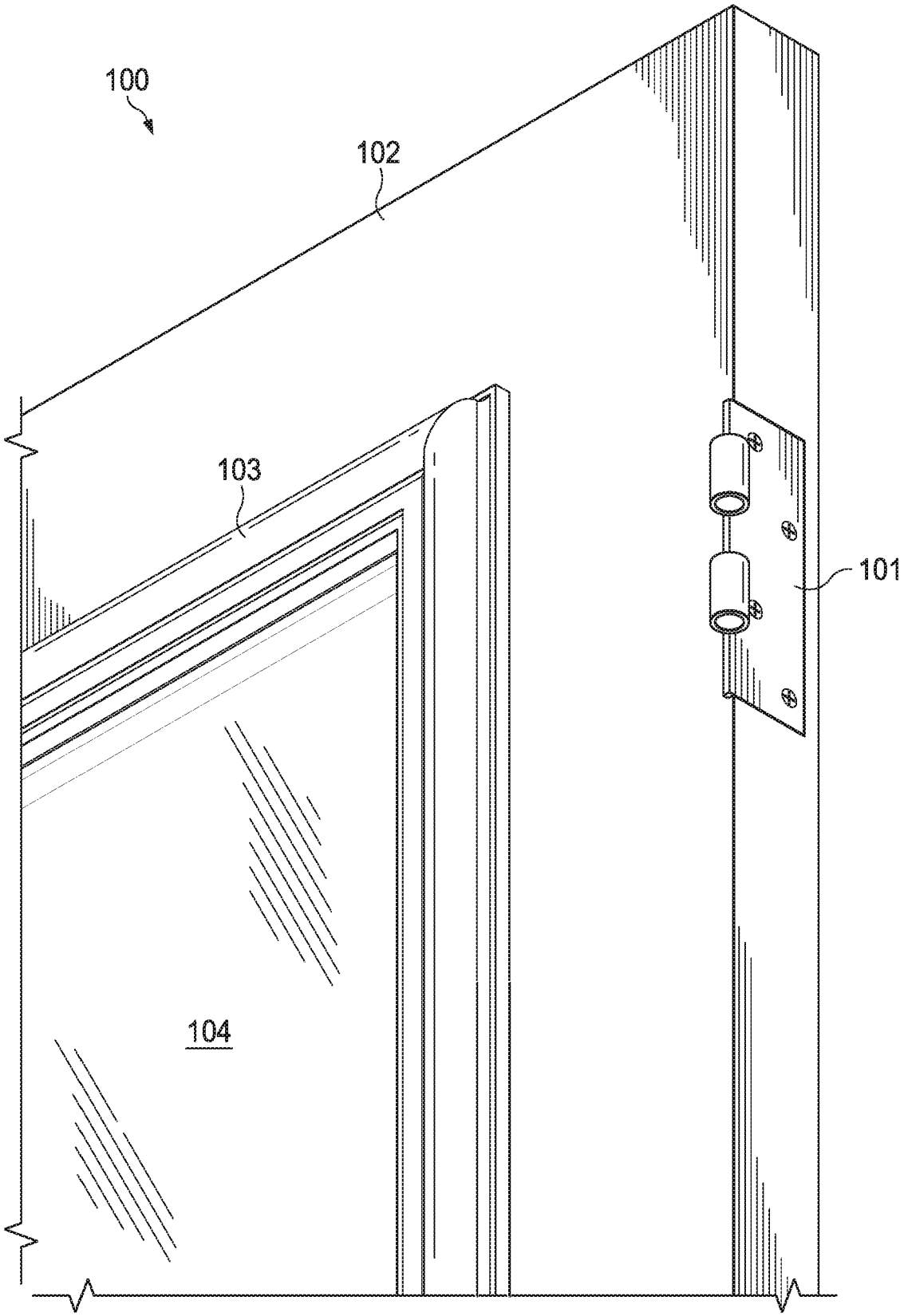
FIG. 1 is a perspective view of a squeeze frame door in one embodiment.

FIG. 1 is a perspective view of a squeeze frame door in one embodiment. A squeeze frame door is a door which features at least one segment which comprises glass. A squeeze frame door squeezes the glass between two opposing frames. While a squeeze frame door is discussed, this is for illustrative purposes and should not be deemed limiting. In other embodiments, the system and method discussed herein can be applied to other types of supports. A support, as used herein, refers to any structure which supports a pane of glass or window. These include but are not limited to doors, standard store front doors, residential and commercial windows which need to be secured using existing attachment systems because they can make many window styles inoperable.

As depicted in FIG. 1, the squeeze frame door 100 comprises a support 102, a pane of glass 104, and an outer frame 103. The support 102 comprises a void into which at least one glass pane 104 is inserted. The support 102 can comprise one or more voids. The support 102 can comprise any material including metal, fiberglass & composite, etc. As depicted, the support 102 further comprises a hinge 101 which allows the support 102 to open and shut.

The pane of glass 104 can comprise virtually any type of glass. The glass 104 can comprise tempered glass, annealed glass, laminated glass, heat treated glass, etc. The glass 104 offers the benefit of increased visibility compared to a solid door. However, as noted above, the glass 104 also offers a weak point in trying to gain access to a structure. No matter how strong the support 102, the hinge 101, or the lock, a traditional glass 104 can simply be broken to permit access to a structure. The traditional glass 104 offers little to no security, and a determined criminal need only throw a brick to circumvent a locked door.

Figure 2:
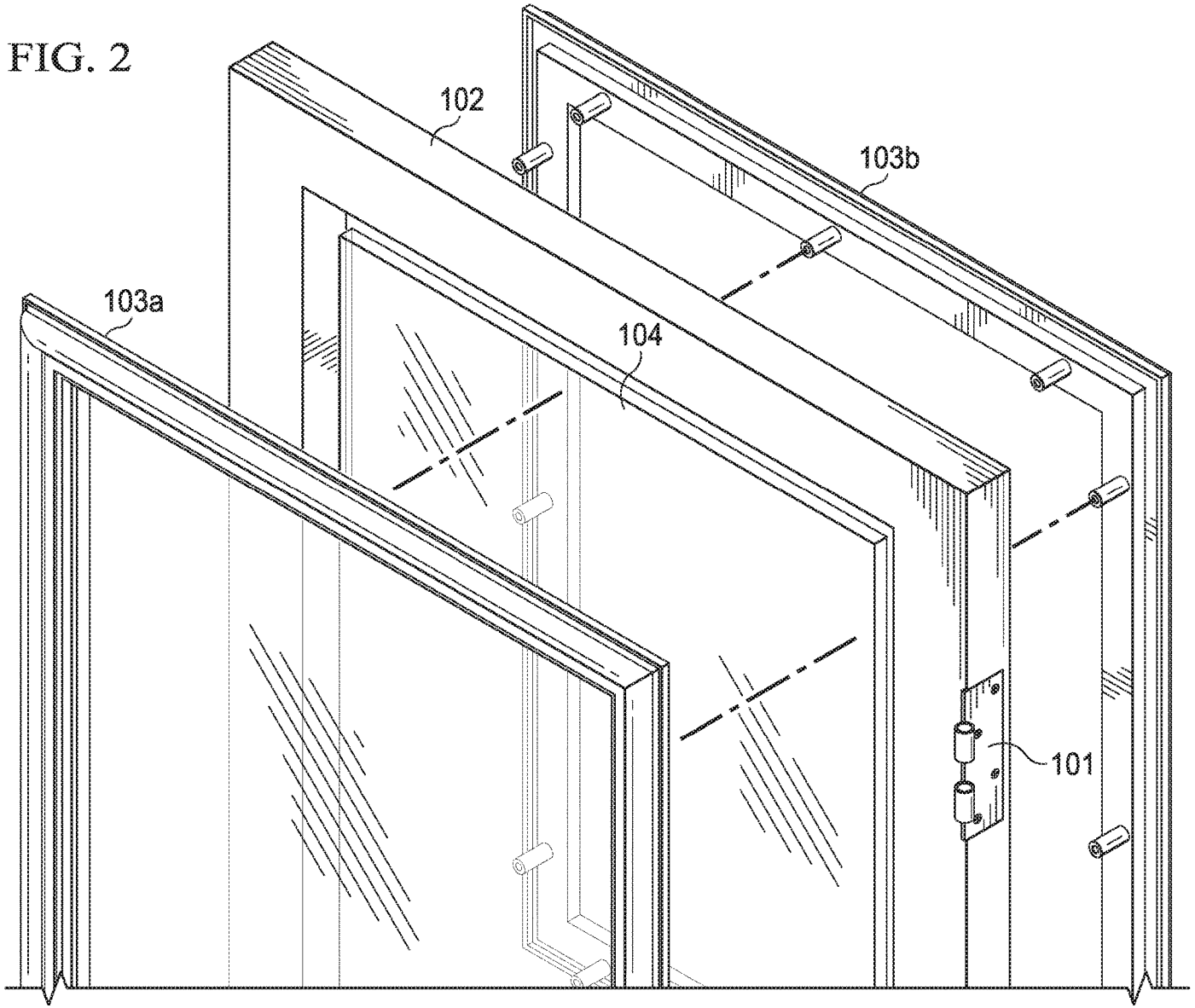
FIG. 2 is a perspective of the frames in one embodiment.

The traditional squeeze frame door 100 has two outer frames 103 which sandwich an inner frame 111. FIG. 2 is a perspective of the frames in one embodiment. As depicted, the inner frame 111 is attached to a pane of glass 104. As shown the inside outer frame 103*b* comprises holes which align with holes in the inner frame 111 and the outside outer frame 103*a*. Accordingly, a screw, bolt, nail, etc. can be used to secure the inside outer frame 103*b* with the inner frame 111 and the inside outer frame 103*a*. This is how the glass 104 is coupled to the support 102. There are other methods to attach and couple the outer frames 103 to the door, and those skilled in the art would understand the various methods and devices used to accomplish. Regardless of the method used, the outer frame 103 is coupled to the support 102 and the glass 104.

Figure 3A:
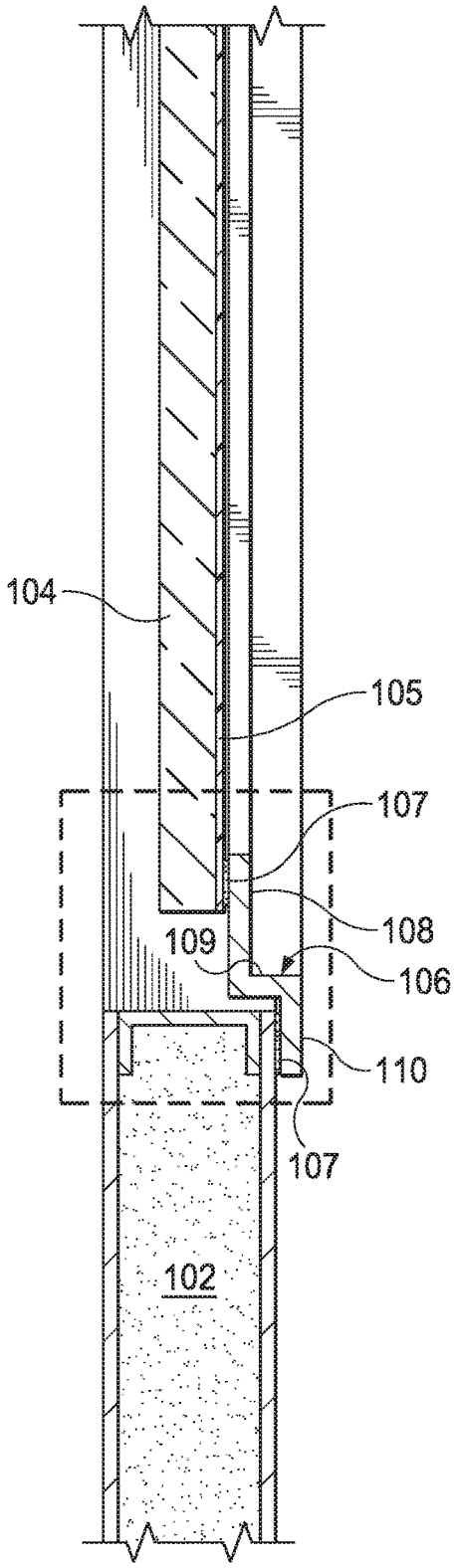
FIG. 3A is a side profile view of a security bracket in one embodiment.
Figure 3B:
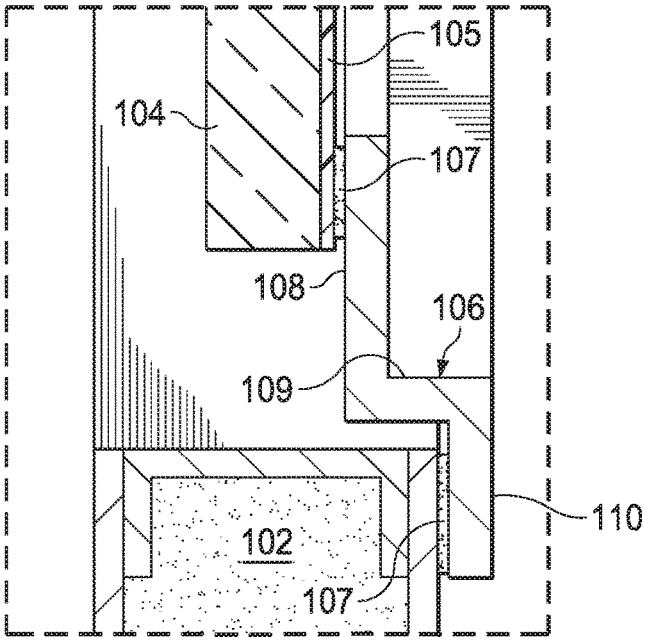
FIG. 3B is an enlarged side profile view of a security bracket shown in FIG. 3A.

FIG. 3A is a side profile view of a security bracket in one embodiment. FIG. 3B is an enlarged side profile view of a security bracket shown in FIG. 3A. The security bracket discussed below secures the reinforced glass to the door.

In FIG. 3A, the glass 104 has been laminated with a security film 105. A security film 105, as used herein, refers to a film which keeps the glass pieces laminated against the film even after the glass has shattered. There are many different types of security films 105 which are suitably used herein. In one embodiment the thickness of the film is no less than 7 mm. The security film can comprise any security film known in the art. In one embodiment the Ultra Series by 3M® is utilized. However, film from other manufacturers such as Madico, Llumar, Hanita, and Solar Gard can also be utilized. In some embodiments the film comprises a thickness of up to 20 mm. As depicted, the security film 105 is adhered to the side of the glass 104 facing on the inside of the structure. Such an arrangement increases the longevity and effectiveness of the film 105 by keeping it away from the elements such as rain, sunshine, etc.

As noted, a security film 105 increases the security of traditional glass 104. The security film 105 aims to keep the shattered glass intact. This is contrasted with a traditional glass which has not been adhered to a security film 105 which will simply shatter and fall away when broken. Security is thereby increased because a glass adhered to a security film 105, in some embodiments, will, in some embodiments, withstand several blows whereas a traditional glass will often not withstand a single blow. However, if the perimeter of the glass 104 adhered to a security film 105 is not properly secured to the support 102, then the glass 104 will simply break at its weak connection point with the support 102, such as a door. Thus, while the glass 104 may remain intact along the security film 105, the entire glass pane 104 will break along the perimeter. This is due, in part, because many films do not extend the entire length of the window pane. Further, there is insufficient support attaching the window 104 to the support 102. The security bracket depicted in FIGS. 3A and 3B overcome these deficiencies.

The security bracket 106 depicted in FIGS. 3A and 3B couple the glass 104 to the support 102. As used herein, coupling refers to the direct connecting of two objects as well as the indirect connecting of two objects. As depicted, the security bracket 106 is coupled to the glass 104 and the security film 105 via an adhesive 107. An adhesive, as used herein, refers to any substance which adheres two or more objects to one another. An adhesive can include, but is not limited to, glue, tape, etc. In one embodiment the adhesive comprises a double-sided tape. In one embodiment the adhesive comprises VHB™ tape manufactured by 3M™. VHB™ tape comprises an acrylic foam which is viscoelastic in nature. The size and specific formulation of the VHB™ tape will depend upon the size, thickness, and type of glass, and other factors. Those skilled in the art will understand the selection of the proper adhesive for a given project. For example, in one embodiment double-sided tape from ULINE™ is utilized. In the examples discussed below, a double-sided tape will be discussed as the adhesive 107. This is for illustrative purposes only, however, and should not be deemed limiting.

As depicted, the adhesive 107 couples the bracket 106 with the glass 104. In one embodiment, and as depicted, the adhesive 107 is sandwiched between the bracket 106 and the security film 105. As noted, in one embodiment the adhesive 107 comprises double-sided tape which adheres to both the bracket 106 and the security film 105.

In one embodiment, and as depicted, the adhesive is adhered to the glass coupler portion 108 of the bracket 106. In one embodiment the bracket 106 comprises three portions: a glass coupler 108, a support coupler 110, and a gap definer 109 which connects the glass coupler 108 to the support coupler 110. In one embodiment, the glass coupler 108 is substantially parallel to the support coupler 110. In one embodiment the glass coupler 108 and the support coupler 110 are substantially perpendicular to the gap definer 109.

The glass coupler portion 108 is the portion of the bracket 106 which adheres to the adhesive 107 and the security film 105 and/or the glass 104. In one embodiment the glass coupler portion 108 is parallel to the orientation of the glass 104 and the security film 105. The glass coupler portion 108 offers sufficient surface area to properly adhere and attach the security film 105. The size of the glass coupler portion 108 can vary with the size of the door, the size of the window, etc. In one embodiment with a conventional squeeze frame door, the glass coupler has a length of about ¾ of an inch. In one embodiment the dimensions of the adhesive 107 are sized so as to match the dimensions of the glass coupler 108. In one embodiment the glass coupler portion 108 comprises a length of between about ⅜ of an inch to about 1 inch.

Coupled to the glass coupler 108 is the gap definer 109. The gap definer 109 provides an off-set distance between the glass coupler 108 and the support coupler 110. The size of the gap definer 109 can be adjusted to accommodate various glass and film thicknesses. In one embodiment the gap definer 109 is sized as to allow the glass coupler 108 to be adjacent to the film 105 and have the support coupler 110 be adjacent to the door 102. In one embodiment the gap definer 109 comprises a length of about ¾ of an inch.

The support coupler 110 couples the bracket 106 to support 102. The support coupler 110 acts like the glass coupler 108 described above. In one embodiment the support coupler 110 adheres to the adhesive 107 which also adheres to the door 102. In one embodiment any paint, sealant or any other such layer above the support surface is removed prior to adhering with the adhesive 107. As an example, if the support 102 is metal, the door 102 is sanded to the metal. This increases the adhesion of the adhesive 107 with the support 102.

The dimensions of the support coupler 110 can vary depending upon the size of the glass, size of the support, etc. In one embodiment the support coupler 110 has a length of about 1 and ¼ of an inch. As with the glass coupler 108, in one embodiment the adhesive 107 has dimensions similar to that of the length of the support coupler 110.

By coupling the glass 104 and the security film 105 to the support 102 via a rigid bracket 106, the glass 104 and the security film 105 remain attached to the support 102 even after the glass 104 has shattered. As noted above, previously if the glass 104 were shattered, even if the shattered glass 104 remained adhered to the security film 105, the entire glass 104 would fall out as a single unit. Now, however, the bracket 106 keeps the glass 104 and security film 105 adhered to the support 102. If the glass 104 is shattered, it remains adhered to the security film 105 and both remain attached to the support. The system, in one embodiment, will withstand several direct collisions before failure occurs, if it occurs at all.

Figure 4:
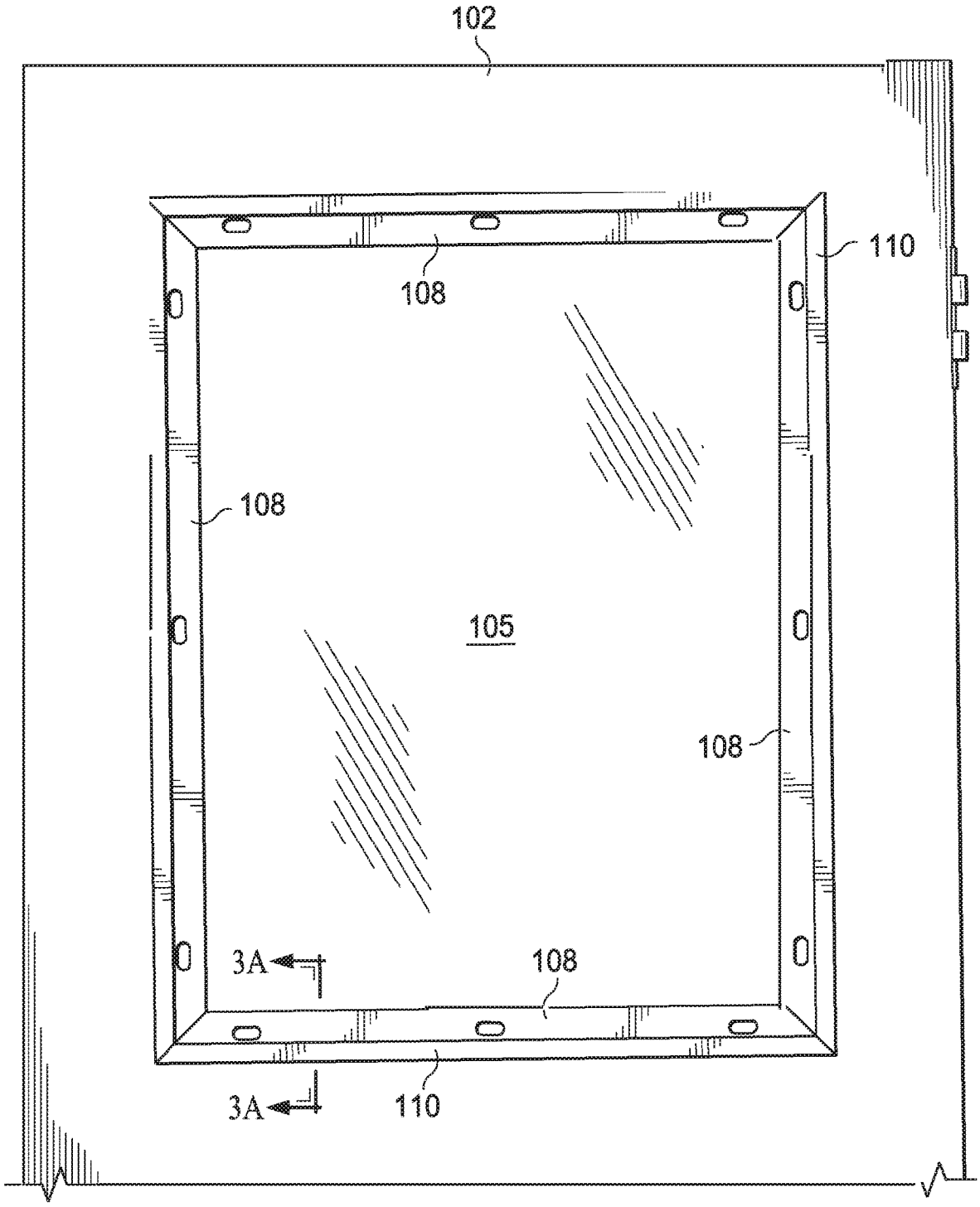
FIG. 4 is a front profile view of a security bracket in one embodiment.

While FIGS. 3A and 3B show a side view, the bracket 106 extends the entire length of the glass 104. FIG. 4 is a front profile view of a security bracket in one embodiment. FIG. 4 depicts the bracket 106 holding the security film 105 and the glass 104 in place within the cavity of a door 102. As depicted, the outer frame 103 has not yet been installed so the security bracket 106 is visible. If, however, the outer frames 103 are attached, the bracket 106 is not visible. In one embodiment the door coupler 110 comprises a hole through which a screw, bolt, etc. can be inserted and coupled to the outer frames 103.

As can be seen, the brackets 106 extend along the outer perimeter of the glass 104 and the security film 105. In the embodiment depicted wherein the glass 104 comprises a rectangular shape, the bracket 106 comprises of two top brackets and two side brackets. Each bracket will be installed are previously discussed. In one embodiment each bracket 106 is independent and is not directly coupled to any other bracket 106. In other embodiments, however, one bracket 106 is directly coupled to at least one other bracket 106. As an example, though not depicted, in some embodiments the top bracket 106 is coupled to the side bracket on the left. The two brackets 106 can be coupled via any device or method known in the art. Connecting two or more brackets 106, in some embodiments, results in increased structural rigidity.

In one embodiment, two or more brackets 106 are integrally made as a single piece. In some embodiments, this increases the structural rigidity of the bracket.

While a rectangular glass has been shown, this is for illustrative purposes only. The method and system disclosed herein can be practiced on glass with virtually any shape including curved, rounded, polygonal, triangular, etc. The number, size, and shape of the brackets 106 will be adjusted accordingly to accommodate the various shapes.

While a system has been described, a method of utilizing the system will now be described in reference to one embodiment. First, the outer frame 103 is removed and the glass 104 is decoupled from any inner frame 111. Thereafter, a security film 105 is applied to the glass 104. In one embodiment the security film 105 is applied such that the film extends to the outer edges of the glass 104. The security film 105 is then allowed to cure on the glass 104. The curing time will depend on several factors including the type of the glass, the type of film 105, the temperature, humidity, etc. In one embodiment, the curing time is about 30 days. In other embodiments the curing time is less than 30 days.

After the security film 105 has cured, an adhesive 107 can now be applied. As noted, in one embodiment the adhesive 107 is applied to side of the glass 104 which has the security film 105. The adhesive 107 is applied along the perimeter of the glass 104. In one embodiment the adhesive is applied to the bracket first and then simultaneously adhered to the glass 104 and the support 102. This process is repeated for every side of the glass 104. For the glass 104 in FIG. 4, this would be repeated for the top, bottom, left-side, and right-side.

After adhesive 107 has been applied, the adhesive 107 is coupled to the glass coupler 108 of the bracket 106. The bracket 106 is applied slowly and a force is applied to the bracket 106 to ensure adherence to the adhesive 107. Note, adhesive 107 can also be applied to the bracket 106 and then adhered to the glass 104.

Next, adhesive 107 is applied to the support 102, such as a door. Like above, adhesive 107 can also be applied to the support coupler 110 of the bracket 106. Adhesive 107 is applied in a location such that the adhesive 107 will adhere to both the support 102 and the security film 105. As above, the bracket 106 is applied slowly, and a force is applied to ensure the adhesive adheres to both the support 102 and the support coupler 110.

After the glass 104 has been installed and coupled to the support 102, the outer frames 103 can be secured as previously discussed. In this manner, in some embodiments, the bracket 106 is hidden from view. The resulting support 102 is one in which the glass 104 is properly secured to both the security film 105 and the bracket 106, and the bracket 106 is properly secured to the support 102. In this manner, the glass 104 can withstand several blows which would otherwise shatter conventional glass 104. Further, because the glass 104 is secured to the support 102 via the bracket 106, the glass 104 can withstand more blows than conventional glass 104 which has been laminated with a security film 105 but not properly attached to the support 102.

As noted above, in some embodiments the time required to cure the security film 105 to the glass 104 is relatively long. If the system discussed herein was going to be installed in a traditional door, for example, then the security film 105 would first need to be installed. Then, after the curing time, the installation crew would need to head to the home or office once again to install the bracket 106. This is undesirable for a variety of reasons. First, it inconveniences the customer. Second, it requires a second trip and, consequently, it is less efficient, driving up costs.

In alternative embodiments, an installation truck, trailer, or van, carries one or more replacement panes of glass 104 that has already been adhered to a security film 105. Thus, the curing time is already complete. The installer need simply remove the old glass and replace it with the new glass 104, security film 105, and the bracket 106.

In still another embodiment, the installation truck, trailer, or van, carries on or more replacement doors. Many of the squeeze frame doors 100 are common in size and appearance. If a customer desires to install the security film 105 and security bracket 106, the entire door can be swapped out with a new door. Thereafter the new door can simply be painted or modified as desired by the customer.

The above methods of installing overcome the many disadvantages associated with the prolonged curing time. This decreases any burden on the customer and makes installation a single trip rather than multiple trips. Thus, what would normally have been a 30 day plus project can now be completed on a single day.

While the invention has been particularly shown and described with reference to a preferred embodiment, it will be understood by those skilled in the art that various changes in form and detail may be made therein without departing from the spirit and scope of the invention.

What is claimed is:

1. A system for a security glass comprising:

a bracket, said bracket comprising:

a glass coupler coupled to a gap definer, wherein said gap definer is coupled to a support coupler;

wherein said glass coupler and said support coupler are substantially parallel, and wherein said glass coupler is substantially perpendicular to said gap definer.

2. The system of claim 1 further comprising a support.

3. The system of claim 2 wherein said support comprises a squeeze-frame door.

4. The system of claim 3 further comprising an inner frame and an outer frame, wherein said glass and bracket are sandwiched between said inner frame and said outer frame, and wherein said bracket is not visible when said inner frame and said outer frame are coupled.

5. The system of claim 1 further comprising a glass and a security film adhered to said glass, and a first adhesive adhering said glass coupler to said security film.

6. The system of claim 5 further comprising a second adhesive, wherein said second adhesive adheres said support coupler to a support.

7. The system of claim 5 comprising a lower bracket coupled to a lower side of said glass, a left bracket coupled to a left side of said glass, a right bracket coupled to a right side of said glass, and a top bracket coupled to a top side of said glass.

8. The system of claim 5 wherein said bracket extends around the entire outer perimeter of said glass.

9. The system of claim 5 wherein said security film extends to the outer perimeter of said glass.

10. The system of claim 1 comprising two or more brackets.

11. The system of claim 1 wherein said lower bracket is coupled to said left and right bracket, and wherein said top bracket is coupled to said left and right bracket.

* * * * *